US011939116B2

(12) United States Patent
Polt

(10) Patent No.: US 11,939,116 B2
(45) Date of Patent: Mar. 26, 2024

(54) LID ASSEMBLY FOR A DRINK CONTAINER

(71) Applicant: B. Robert Polt, Redmond, WA (US)

(72) Inventor: B. Robert Polt, Redmond, WA (US)

(73) Assignee: Ruumi Cup Corporation, Redmond, WA (US)

( * ) Notice: Subject to any disclaimer, the term of this patent is extended or adjusted under 35 U.S.C. 154(b) by 108 days.

(21) Appl. No.: 17/497,543

(22) Filed: Oct. 8, 2021

(65) Prior Publication Data

US 2022/0112005 A1 Apr. 14, 2022

Related U.S. Application Data

(60) Provisional application No. 63/090,212, filed on Oct. 10, 2020.

(51) Int. Cl.
*B65D 43/20* (2006.01)
*A47G 19/22* (2006.01)

(52) U.S. Cl.
CPC ..... *B65D 43/20* (2013.01); *A47G 19/2272* (2013.01); *B65D 2543/00046* (2013.01); *B65D 2543/00055* (2013.01); *B65D 2543/00092* (2013.01)

(58) Field of Classification Search
CPC .... B65D 51/243; B65D 51/18; B65D 47/286; B65D 43/20; B65D 43/12; B65D 2543/00092; B65D 2543/00055; B65D 2543/00046; B65D 2251/0018; A47G 19/2272
USPC ... 220/200, 242, 254.1, 254.9, 345.1, 345.4, 220/351; 222/559–561
See application file for complete search history.

(56) References Cited

U.S. PATENT DOCUMENTS

| | | | | |
|---|---|---|---|---|
| 9,145,238 | B2 * | 9/2015 | Barreto | B65D 47/32 |
| 9,351,597 | B2 * | 5/2016 | Liu | A47G 19/2272 |
| 10,183,789 | B1 * | 1/2019 | Lin | A47G 19/2272 |
| 2018/0332987 | A1 * | 11/2018 | Lin | B65D 47/305 |
| 2022/0112011 | A1 * | 4/2022 | McNamara | B65D 51/18 |
| 2023/0029205 | A1 * | 1/2023 | Omdahl, II | A47G 19/2222 |

* cited by examiner

*Primary Examiner* — James N Smalley
*Assistant Examiner* — Madison L Poos
(74) *Attorney, Agent, or Firm* — K&L Gates LLP

(57) ABSTRACT

A lid assembly is disclosed for drink containers. An example lid assembly can include a lid and a slider. The lid includes a sip hole, a first lid flat portion, and a first lid recess portion having a first track on a side wall adjacent to the first lid flat portion. The slider includes a winged extension configured to fit the first lid flat portion, and a central portion configured to fit the first lid recess portion. The central portion includes a first tab on a side of the central portion to engage the first track. The lid further includes a first lid step portion from the first flat portion that restrains the first winged extension from sliding out of the first track and a nose recessed portion at the end of the first lid recessed portion that allows the slider to be inserted.

20 Claims, 9 Drawing Sheets

LID ASSEMBLY FOR A DRINK CONTAINER

CROSS-REFERENCE TO RELATED APPLICATION

The present application claims priority to U.S. Provisional Patent Application No. 63/090,212, filed Oct. 10, 2020, the entire contents of which is incorporated herein by reference.

TECHNICAL FIELD

The present disclosure relates generally to drink containers and, more specifically but not exclusively, the present disclosure relates to a lid assembly including a lid and a slider for a drink container (e.g., a container for a beverage, a liquid, flowable food, cups, mugs, and the like).

BACKGROUND

A large percentage of the population enjoys drinking one or more cups of coffee daily and this created a whole industry around it. As the society became more dynamic, many people take their coffee with them on the go requiring lids to contain spills and keep coffee warm. Many of these lids have movable parts used to cover the sip hole to contain splashes and spills or to keep the beverage warm.

SUMMARY

The present disclosure relates to a lid assembly for a drink container (e.g., a container for beverage/liquid/flowable food, cup, mug, or the like). An example lid assembly can include a lid and a slider. The lid is configured to engage a top periphery of a drink container and substantially cover an open top surface of the drink container. The lid includes a sip hole, a first lid flat portion and a first lid recess portion having a track on a side wall adjacent to the first lid flat portion. A lid nose recess portion is adjacent to the first flat portion and in continuation of the first recess portion. It can, for example, accommodate a nose of a user.

The first flat lid portion accommodates horizontal sliding of the slider. This area can however be imagined as being curved and sliding to take place along a cylindrical surface or, it may have depressions and other features that will not invalidate the flatness assumption.

The slider is configured to slide to an open position (e.g., a position that the sip hole is fully or partially exposed) or a closed position (e.g., a position that the sip hole is covered). The slider (also referred to as a winged slider) includes a first winged extension that slides along the first lid flat portion.

To prevent the slider from being pushed forward and accidentally exiting the lid tracks and separating from the lid, the flat portion may contain a step portion positioned at the edge of the slider winged extension when the slider is in open position so that sliding of the slider beyond that point is obstructed.

The first flat portion can be recessed from the top surface of the lid and can contain a vent-hole portion with a vent hole (e.g., a hole exposing the interior of the container to an exterior environment) and an indentation. In this case, the step portion can be the wall or part of the wall of the recess.

The first winged extension can be configured to fit the vent-hole portion, and a central portion configured to fit the first lid recess portion. The winged extension includes a protrusion and a channel (e.g., a recess portion that forms a gap between the winged extension and the top of the vent hole). The protrusion fits the vent hole and the indentation (e.g., the protrusion enters the indentation to fill the indentation to keep the slider in an open position), and the channel exposes the vent hole to air outside of the container (e.g., the gap providing an access to the outside). The central portion includes a tab on a side of the central portion to engage the track.

In some embodiments, the lid assembly can have a symmetric configuration. For example, the lid flat portion can further include an additional vent-hole portion having an additional vent hole and an additional indentation. The first lid recess portion can further include an additional track adjacent to the additional vent-hole portion. The slider can further include an additional winged extension having an additional protrusion and channel configured to fit the additional vent-hole portion. The central portion can further include an additional tab to engage the additional track.

Each side of the lid assembly can have a slider insertion and removal system that enables a smooth removal and insertion of the slider. The removal system can include ramps and steps that facilitate controlled passing of the slider over the step portion and easy positioning of the slider for insertion. In some embodiments, the lid assembly can have an asymmetric configuration. For example, the slider insertion and removal system on each side of the lid assembly can be different, e.g., a side-wall indentation/a step/an insertion step can be on one side, but not on the other side.

BRIEF DESCRIPTION OF THE DRAWINGS

The foregoing features of the present disclosure will be apparent from the following Detailed description of the present disclosure, taken in connection with the accompanying drawings, in which.

DETAILED DESCRIPTION

The present disclosure relates to a lid assembly for a drink container. The lid assembly includes a lid fitted with a slider that does not require a through the lid opening for installation or magnets and can be easily removed and installed for cleaning. The slider has click in features for open or closed positions and vents for equalizing pressure during sipping. The lid assembly is described in detail below in connection with FIGS. 1-16.

A Lid Assembly

Figure 1:
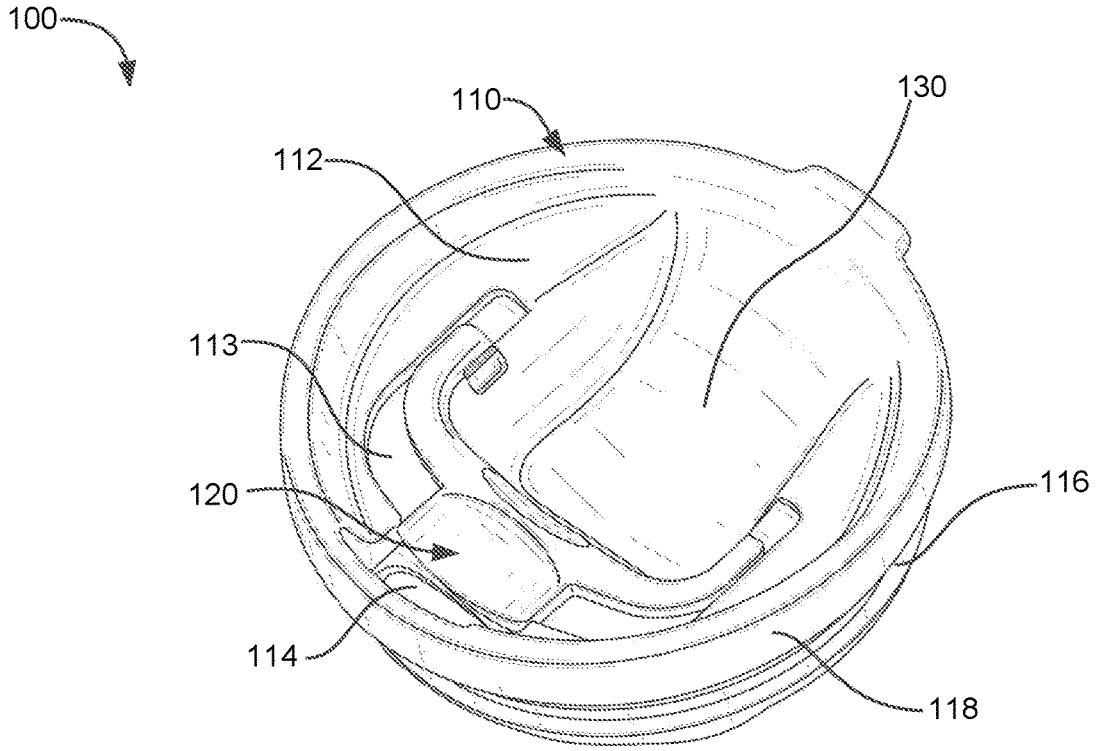
FIG. 1 illustrates an example lid assembly in an open position of the present disclosure.

Turning to the drawings, FIG. 1 illustrates an example lid assembly 100 in an open position of the present disclosure. The lid assembly 100 includes a lid 110 and a winged slider 120 (also referred to as a slider). The lid 110 has a top surface 112, a recessed flat surface 113, a sip hole 114, a lower rim 116 that engages with a container (not shown in FIG. 1), and an upper rim 118 defining a side top and side wall. A nose recess 130 can be used to accommodate a nose of a user who uses the lid 110. FIG. 1 shows that the lid assembly 100 is in an open position such that the sip hole 114 is exposed to air.

Figure 2:
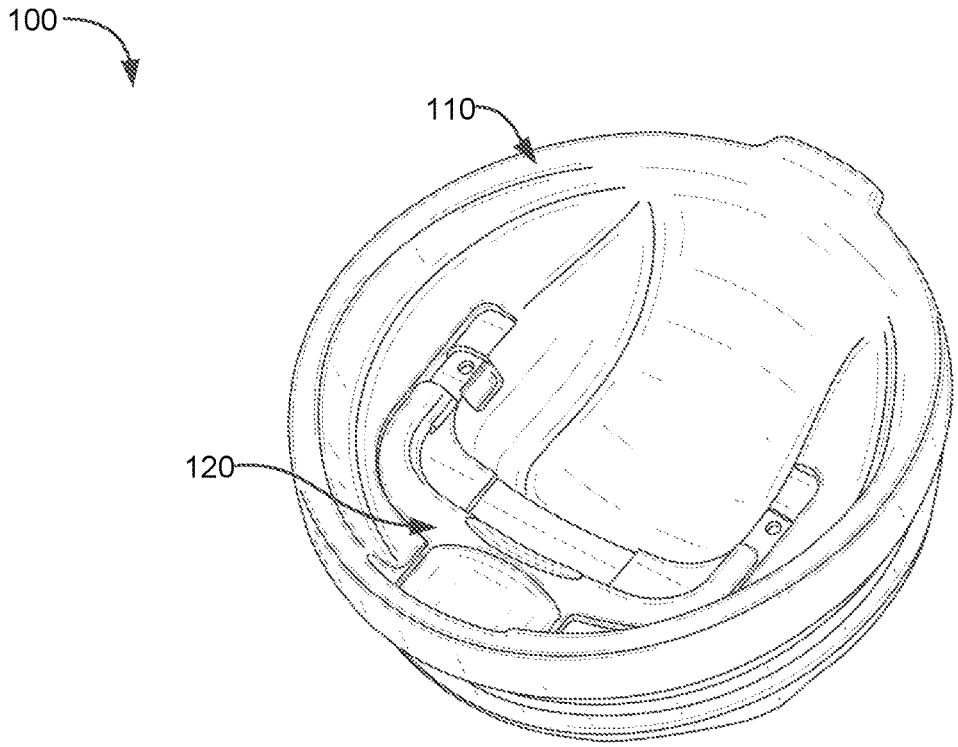
FIG. 2 illustrates an example lid assembly in a closed position of the present disclosure.

FIG. 2 illustrates the lid assembly 100 in a closed position of the present disclosure. The winged slider 120 slides in the lid 110 between an open position and a closed position. In the closed position the winged slider 120 covers the sip hole 114 such that the sip hole 114 is not exposed to air.

Figure 3:
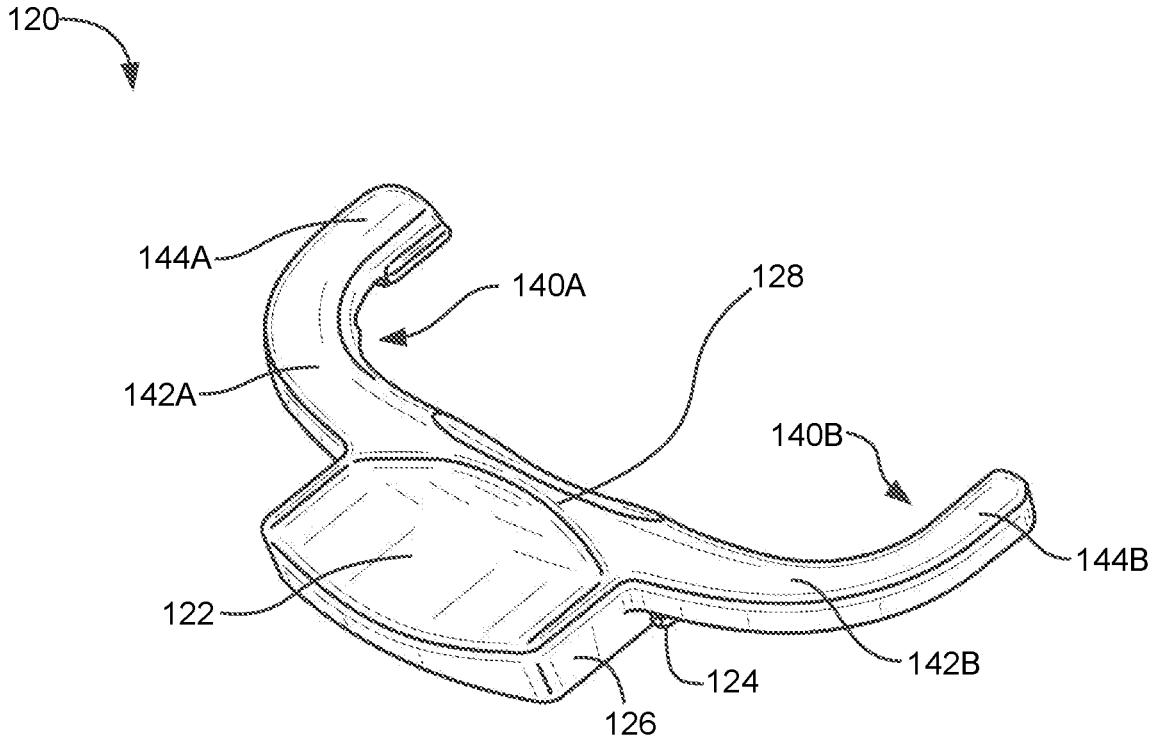
FIG. 3 illustrates a top view of an example winged slider of the present disclosure.

FIG. 3 illustrates a top perspective view of an example winged slider 120 of the present discourse. The winged slider 120 includes a central portion 122 to cover the sip hole 114 (shown in FIG. 1) and two winged extensions 140A and 140B on each side of the winged slider 120. When the winged slider 120 is combined with the lid 110, each of the two winged extensions 140A and 140B can cover vent holes 152 (shown in FIG. 5) located on each side of the lid 110. Each winged extension 140A or 140B has a respective wing portion 142A/142B and a respective winglet portion 144A/144B. The central portion 122 has tabs 124 on each side that engage tracks 162 of the lid (shown in FIGS. 5 and 6). The side walls 126 of the slider central portion slide against the interior sides 166 (shown in FIG. 6) of the lid recess portion 160 (shown in FIG. 5) that act as guides for the slider 120 during the opening and closing motion. The winged slider 120 includes a handle 128 to facilitate closing and opening.

It is understood that, in a different embodiment, the winged extensions may not have the winglet portions. Also, the wing portions may have different shapes and sizes.

Figure 4:
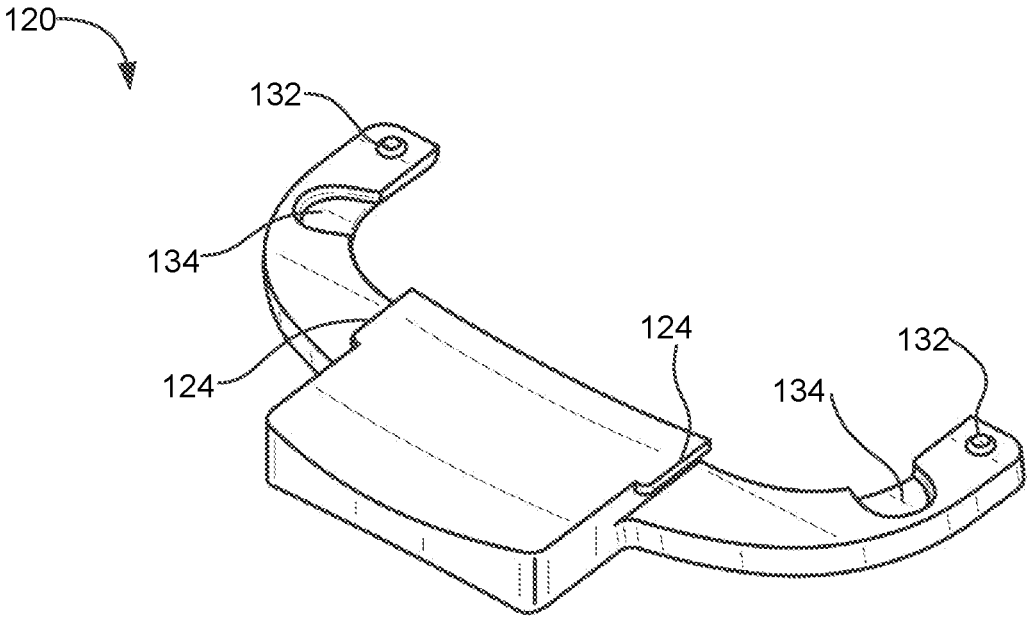
FIG. 4 illustrates a bottom view of the example winged slider of FIG. 3.

FIG. 4 illustrates a bottom perspective view of an example winged slider 120 of FIG. 1. The winged slider 120 further includes one protrusion 132 on each of the winged extensions 140A and 140B. The protrusions 132 can snap fit into the indentations 154 or vents 152 (shown in FIG. 5) of the lid 110 to keep the winged slider in a desired position. A channel 134 on each of the winged extensions 140A and 140B can align with a corresponding vent hole to create a way for the air to equalize pressure when the beverage in the container is consumed. In some embodiments (shown in FIGS. 10-12), the slider can include a central profile if additional help guide the winged slider 120 move between an open position and a closed position is needed.

Figure 5:
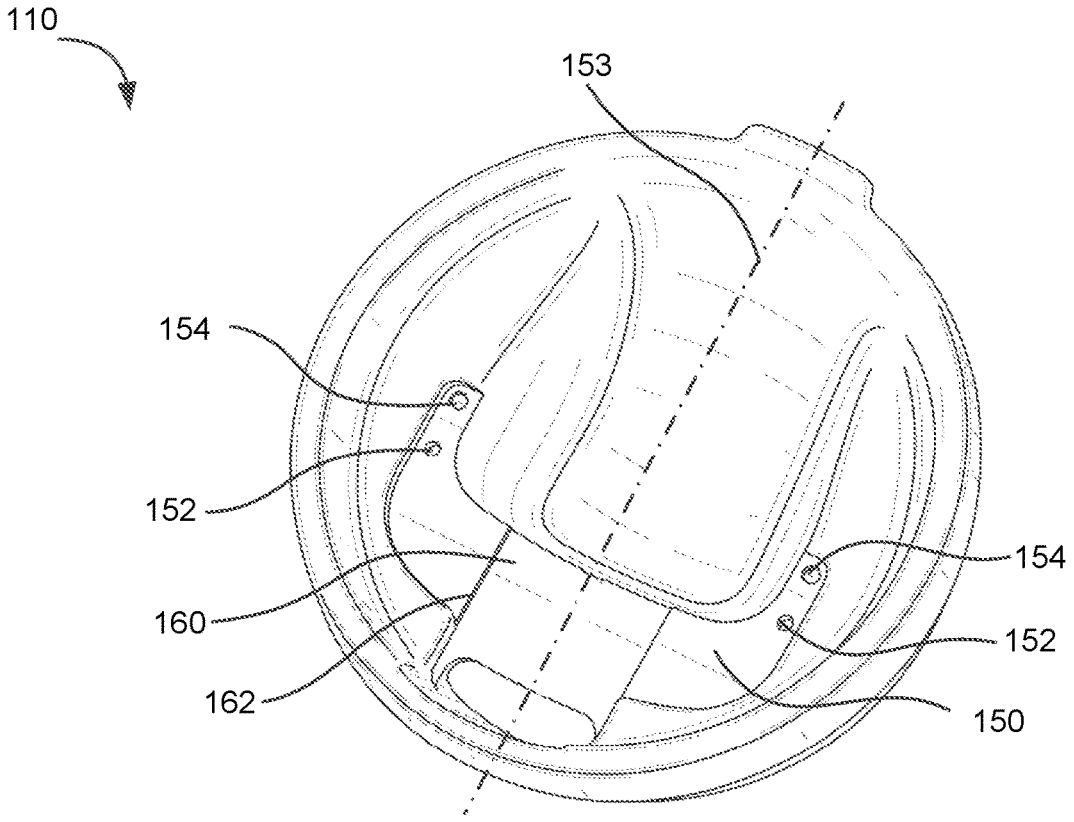
FIG. 5 illustrates an example lid for a winged slider with the winged slider removed of the present disclosure.

FIG. 5 illustrates an example lid 110 of the lid assembly 100 of FIG. 1. The lid 110 has two vent holes 152 and two indentations 154 distributed in a lid flat portion 150. The lid flat portion 150 is recessed to make the top surface of the slider 120 flush with the top surface of the lid 110 and has a shape and dimensions that correspond to a shape and dimensions of the winged slider 120 with a central guide profile. The side walls of the recessed lid flat portion 150 also provide guides for the slider 120 when it is moved between close and open positions. In some embodiments, the lid flat portion 150 can be symmetrical along a center line 153 of the lid 110 with at least one vent hole and at least one indentation on each side of the center line 153.

As shown in FIGS. 3-5, to equalize pressure that builds inside the drink container when the drinkable food (e.g., beverage, tea, coffee, smoothies, soda, gruel, or the like) is consumed, the vent holes 152 are placed at a distance from the sip hole 114 to avoid drinkable food coming out through the vent holes 152 when the drink container is tilted in a usual drinking position. The winglet portions 144A and 144B cover the vent holes 152 when the slider 120 is in the closed position. In the closed position, the protrusions 132 enter the vent holes 152 and/or together with the rest of the winglet portions 144A and 144B to cover the vent holes 152 to protect against leakage or splashes from the vent holes. The protrusions 132 can have a conical or spherical shape that lifts them out of the holes when the winged slider 120 is pushed against the edge of the vent holes 152. This allows the winglet portions 144A and 144B of the winged slider 120 to move out of the closed position until the protrusions 132 meet the indentations 154. Like the vent holes 152, the indentations 154 can have a diameter equal or slightly larger than a diameter of the protrusions 132 allowing the protrusions 132 to fit inside. Due to the flexibility of the wing portions 142A and 142B, and winglet portions 144A and 144B, the protrusions 132 will enter the indentations 154, which locks the winged slider 120 in the open position. An open or partially open position of the winged slider 120 is defined when the vent holes 152 are not entirely covered by the protrusions 132. The winged slider 120 will stay in this open position until it is pulled out of it.

The protrusions 132, the vent holes 152, and the indentations 154 may provide a click-in-position functionality so that a user hears a clicking sound and feels the stop of the winged slider 120 in the open and closed positions. In some embodiments, intermediate open positions can be provided by providing additional indentations.

Figure 6:
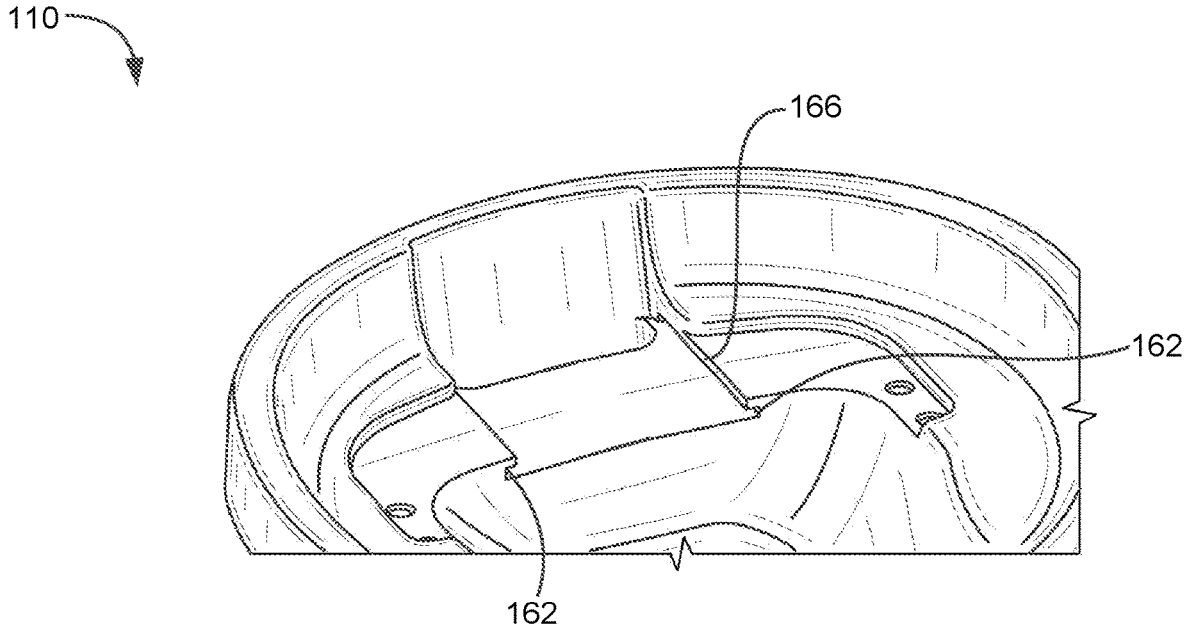
FIG. 6 illustrates example tracks and an example guiding walls of FIG. 5.

FIG. 6 illustrates example tracks 162 and example guiding walls 166 of the lid 110 of FIG. 1 in greater detail. As described above, the tabs 124 (shown in FIGS. 3 and 4) on each side engage the tracks 162 of the lid 110. The interior sides 166 of the lid recess portion 160 act as guides for the slider 120 during the opening and closing motion.

Figure 7:
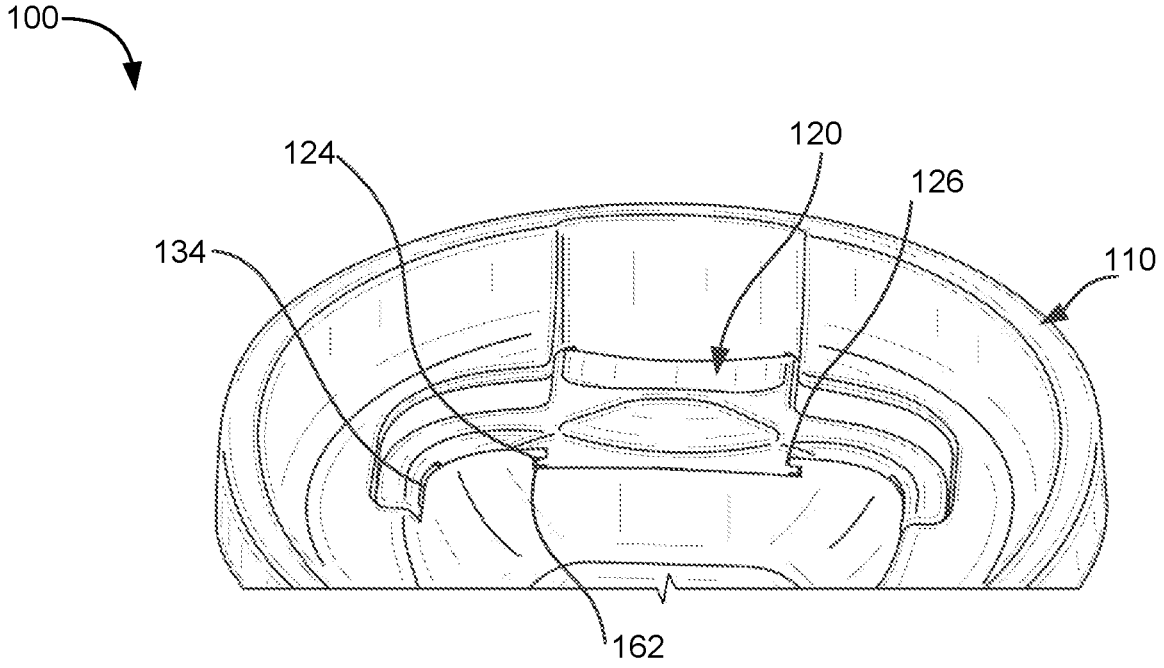
FIG. 7 illustrates a detail view of the slider installation of the example lid assembly of FIG. 1.

FIG. 7 illustrates a detail view of the slider installation of the example lid assembly 100 of FIG. 1. FIG. 7 shows the relative positions of the lid 110 and slider 120. The central portion of the slider 120 is attached to the lid 110 by means of slider tabs 124 that engage lid tracks 162. This way, the winged slider 120 is free to slide in a longitudinal direction (e.g., toward and away from the sip hole 114) but is restrained from moving in a vertical direction (e.g., perpendicular to the top surface of the lid 110) as long as the tabs 124 are still engaged in the tracks 162. The winged slider 120 is guided by the slider guiding sides 126 that slide against the lid guiding sides 166.

Slider Insertion and Removal

A lid assembly can include features that facilitate a smooth insertion and removal of a winged slider as taught herein.

Figure 8:
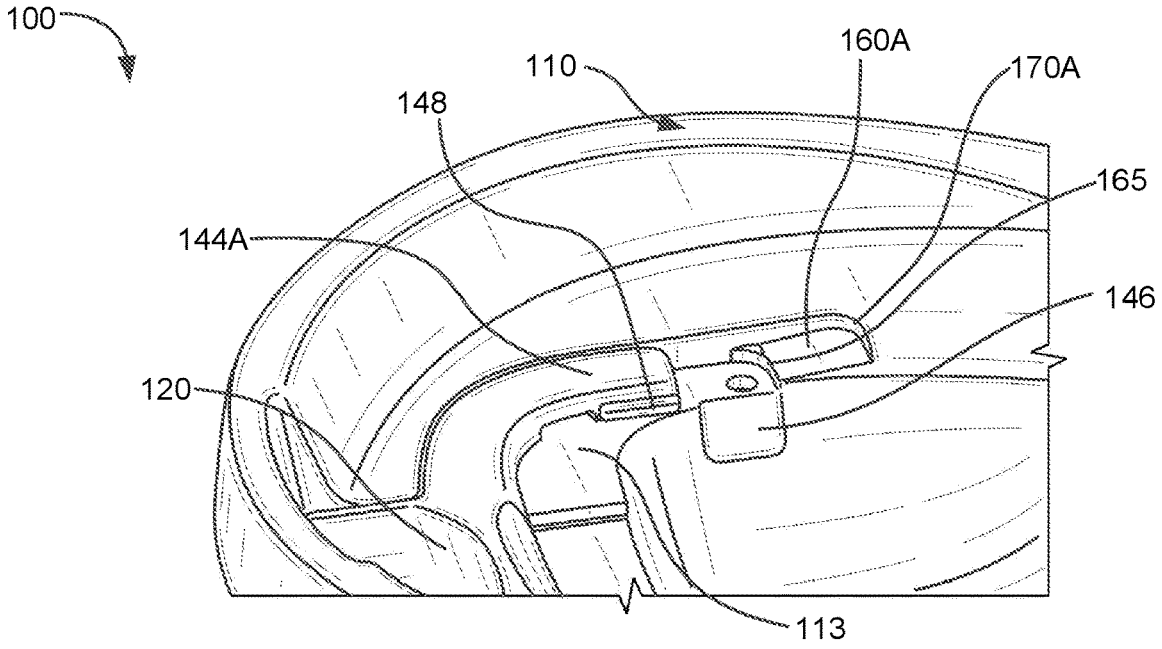
FIG. 8 illustrates a bounded winglet portion of a slider insertion and removal system of a lid assembly of the present disclosure.

In some embodiments, one or more steps from the first flat portion to one or more ramps can bound one of the winglet portions or can bound both of the winglet portions. If one winglet portion is bounded (e.g., using a step from a first lid flat portion to a ramp to restrain the winglet portion), the other winglet portion may continue sliding along another ramp without obstruction FIG. 8 illustrates a bounded winglet portion of a slider insertion and removal system of the lid assembly 100 of FIG. 1. The first flat portion 113 of lid 110 accommodating a left winglet portion 144A of the winged slider 120, has a step 165 between the lid flat portion 113 and the ramp 160A, that restrains the winged slider 120 from being pushed or moved past the open position for removal. The side-wall indentation 146 and winglet lifting tab 148 allow a finger of a user to grab a winglet portion 144A from underneath and lift it over the step 165. Ramp 160A ends with second step 170A used for proper positioning of the slider when it is inserted. The second step 170A also reduces the slope of the ramp 160A making the slider easier to remove and install since less flexing of the winged portion in required.

Figure 9:
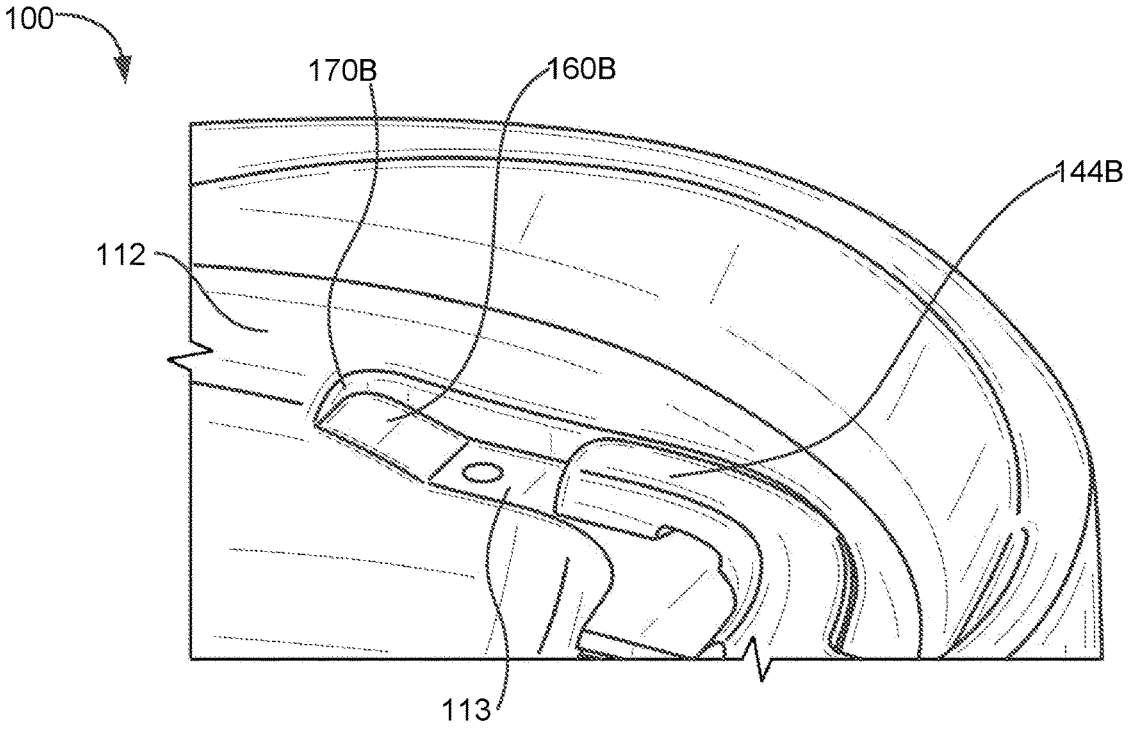
FIG. 9 illustrates an unbouded winglet portion of a slider insertion and removal system of a lid assembly of the present disclosure.

FIG. 9 illustrates an unbouded winglet portion of a slider insertion and removal system of a lid assembly of FIG. 1. The lid flat portion 113 is continued to a ramp 160B that ends with an insertion step 170B. The ramp 160B is inclined continuously and gradually to the flat portion 113 of the lid 110. There is no discrete step between the lid flat portion 113 and the ramp 160B to restrain the winglet portion 144B. The winglet portion 144B can continue sliding along the ramp 160B without obstruction and without the unbounded winglet portion being lifted by hand. This makes removal of the winged slider easier by only having to lift the winglet portion bounded by the step while, at the same time, assuring that the winged slider cannot be accidentally removed.

Pushing the winged slider 120 forward while lifting the winglet portion 144A moves the winged slider 120 forward until tabs 124 (shown in FIGS. 3 and 4) of the winged slider 120 are out of the tracks 162 (shown in FIGS. 5 and 6 for a lid assembly 160) of the lid 110 separating the winged slider 120 from the lid 110.

To install the winged slider back on the lid, a user can slide the slider tabs back into tracks of the lid. For easier insertion, the winged slider is positioned behind the insertion steps 170A and 170B and slid back. The insertion steps provide guides for positioning of the slider for insertion and reduce or eliminate the amount of downward pressure needed to be exerted on the handle 128 during insertion.

Additional Embodiments of Lid Assembly with Winged Sliders

Figure 10:
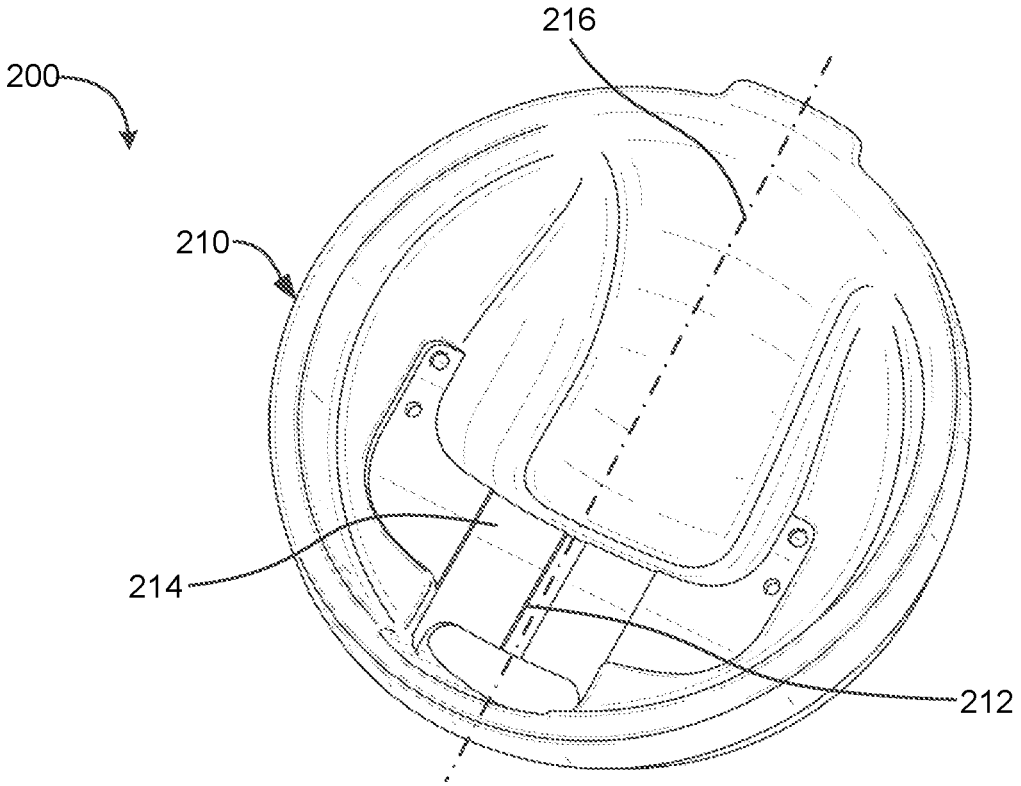
FIG. 10 illustrates another example lid assembly having a different winged slider design.
Figure 11:
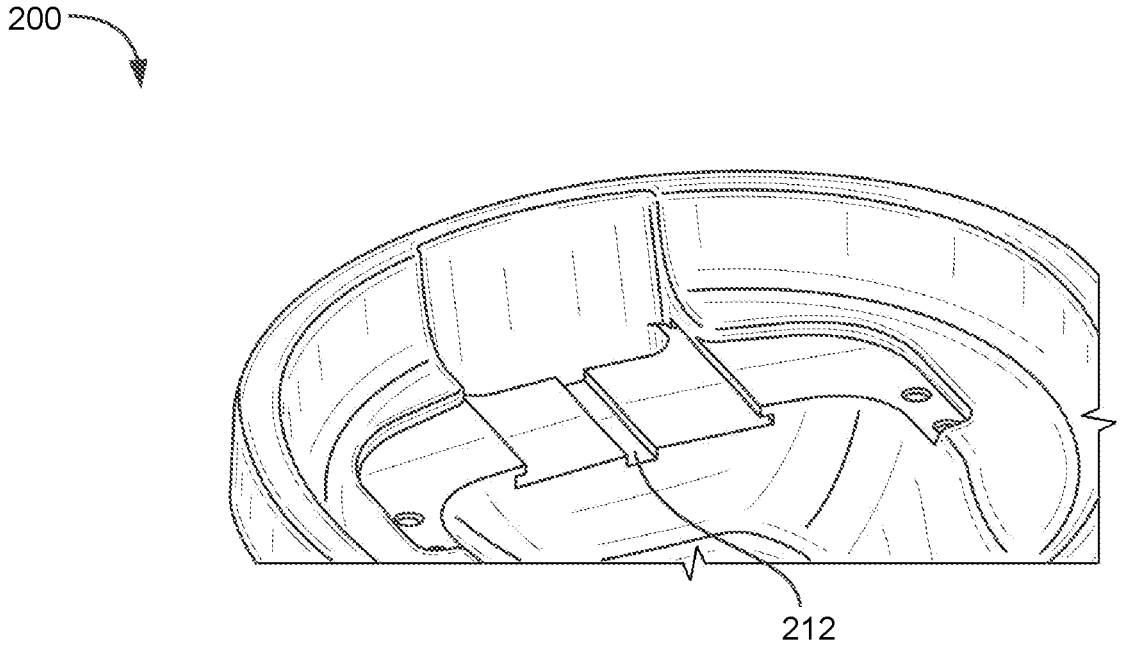
FIG. 11 illustrates an example central guiding channel of the lid of FIG. 10 in greater detail.
Figure 12:
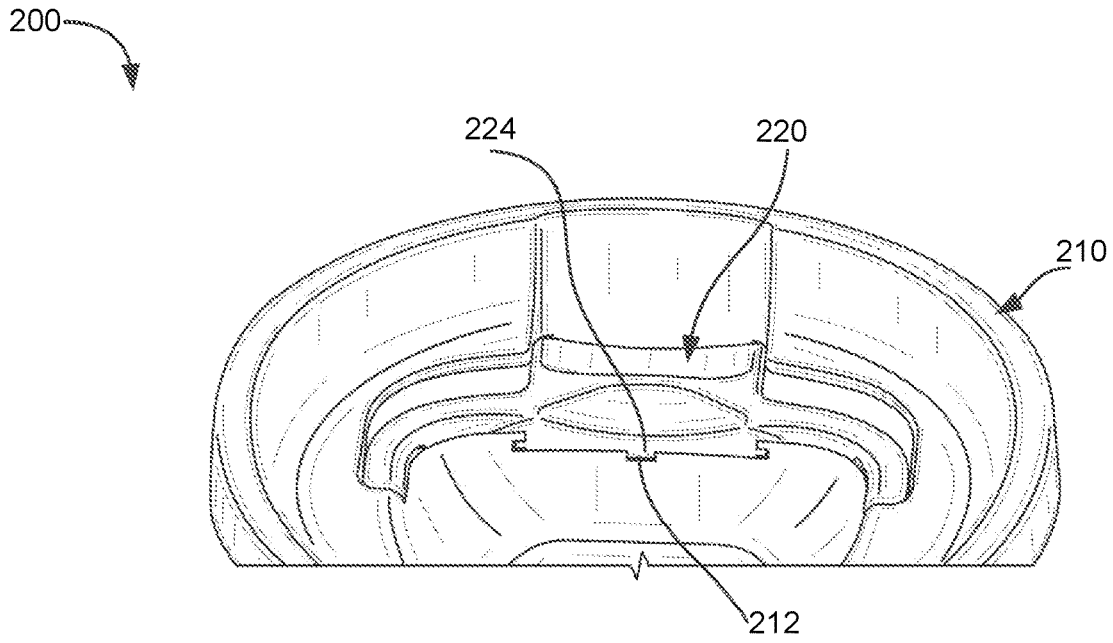
FIG. 12 illustrates a detail view of the slider installation of the example lid assembly of FIG. 10.

FIGS. 10-12 illustrate another example lid assembly 200 of the present disclosure. The lid assembly 200 is one of embodiments of the lid assembly 100. FIG. 10 shows an example lid 210 of the lid assembly 200. The lid 210 is one of embodiments of the lid 110. Compared with the lid 110 shown in FIGS. 5 and 6, the lid 210 further include a central guiding channel 212 on a lid recess portion 214 along a center line 216 of the lid 210 to provide an additional guidance to guide a slider 220 to move between an open position and a closed position. FIG. 11 illustrates the example central guiding channel 212 of the lid 210 of FIG. 10 in greater detail. FIG. 12 shows the assembly of lid 210 and slider 220. The slider 220 can be one of embodiments of the slider 120. Compared with the slider 120 in FIGS. 3 and 4, the slider 220 further includes a central profile 224 that can fit in the central guiding channel 212 (shown in FIGS. 10 and 11) to guide the slider 220 to move between an open position and a closed position. The central guiding channel 212 and the matching central profile 224 can be provided to minimize racking that can occur when the width of the winged slider 220 is relatively large compared to its length.

It will be recognized that the winged slider can have a different planform and top surface designs that maintain the functionality described herein.

Figure 13:
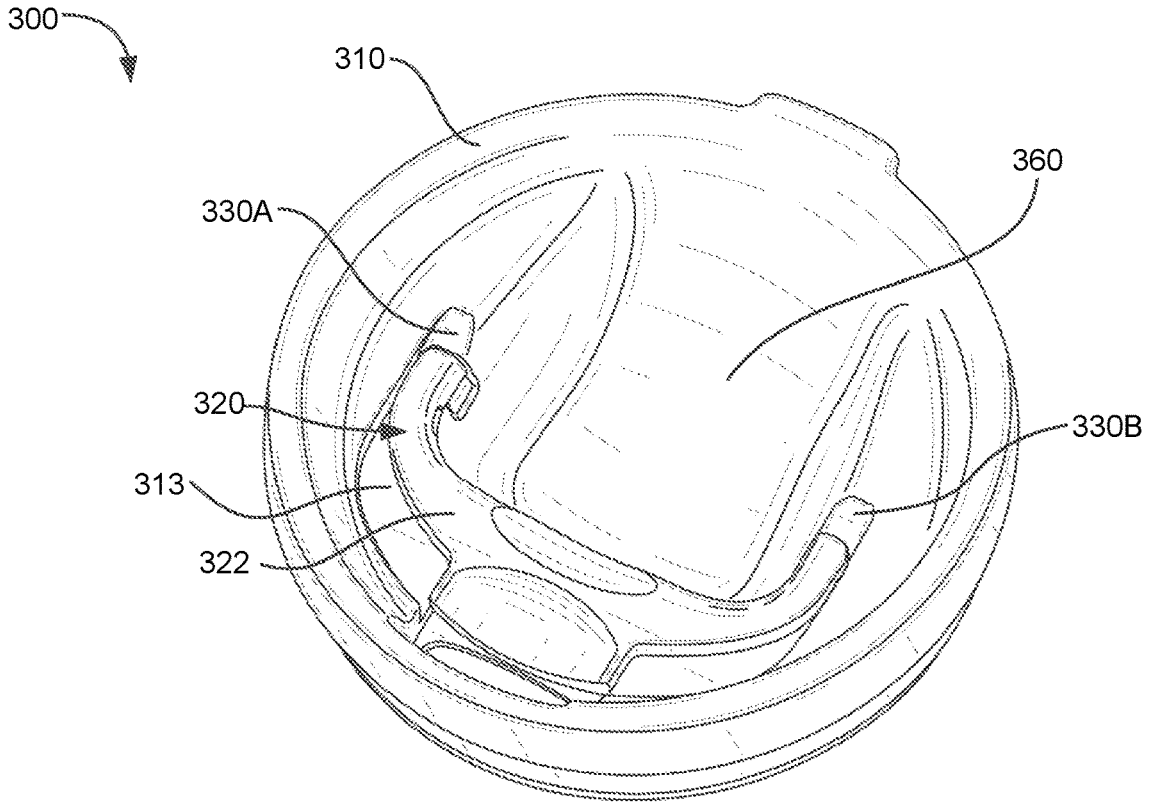
FIG. 13 illustrates another example lid assembly of the present disclosure.

FIG. 13 illustrates another example lid assembly 300 of the present disclosure. The lid assembly 300 includes a lid 310 and a slider 320. The slider 320 has a different planform with wings that have portions 322 wider next to the central portion of the slider 320, compared with the sliders 120 and 220 of FIGS. 3 and 10. The lid flat portion 313 of the lid 310 accommodates the slider 320. For example, the lid flat portion 313 can be wider than the lid flat portion 113 of FIG. 1 to fit the slider 320. The lid assembly 300 further includes ramps 330A and 330B to facilitate removal and insertion of the slider 320. The ramps 330A and 330B can be placed symmetrically or asymmetrically. In some embodiments (not shown), the lid assembly 300 can only include one ramp in total instead of having a ramp on each side.

Additional Lid Assemblies with Non-Winged Slider

Figure 14A:
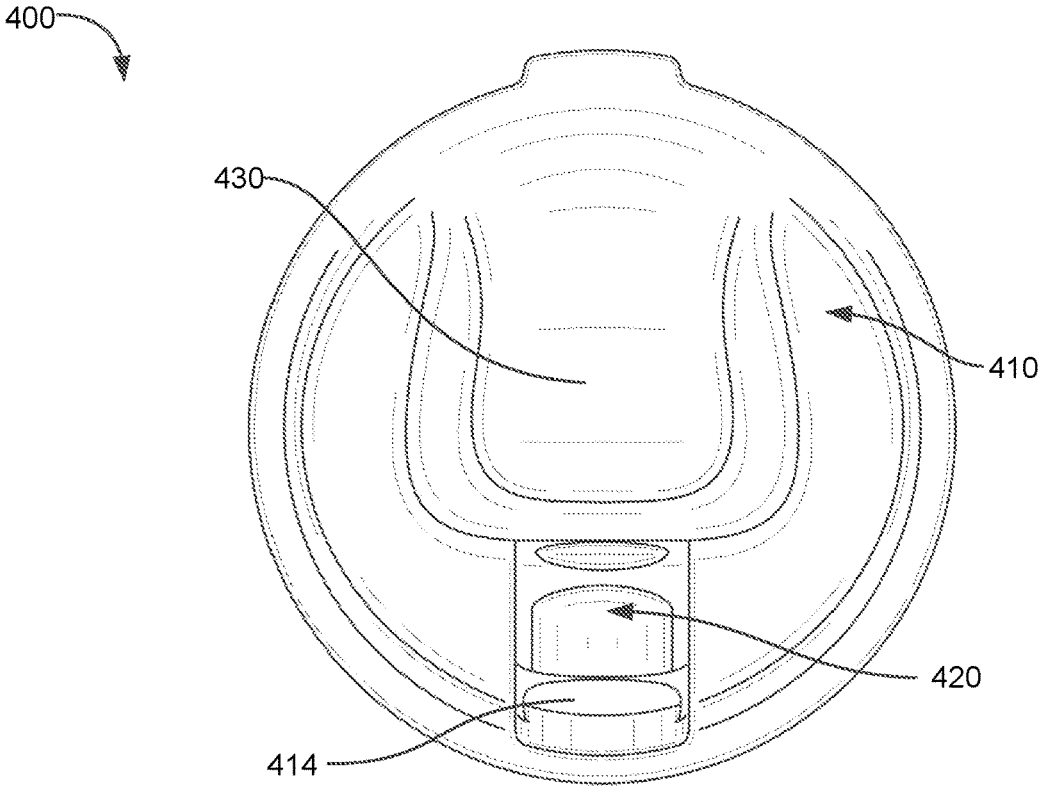
FIGS. 14A and 14B illustrate another example lid assembly with a non-winged slider in open and close positions.
Figure 14B:
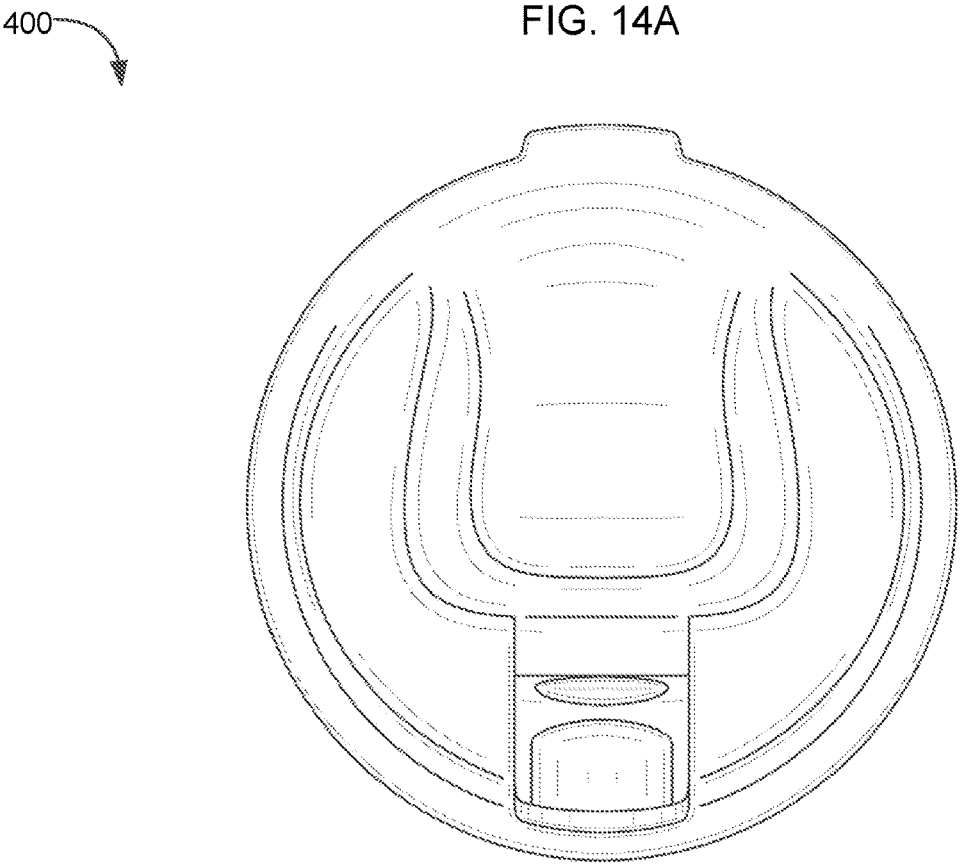
Figure 16:
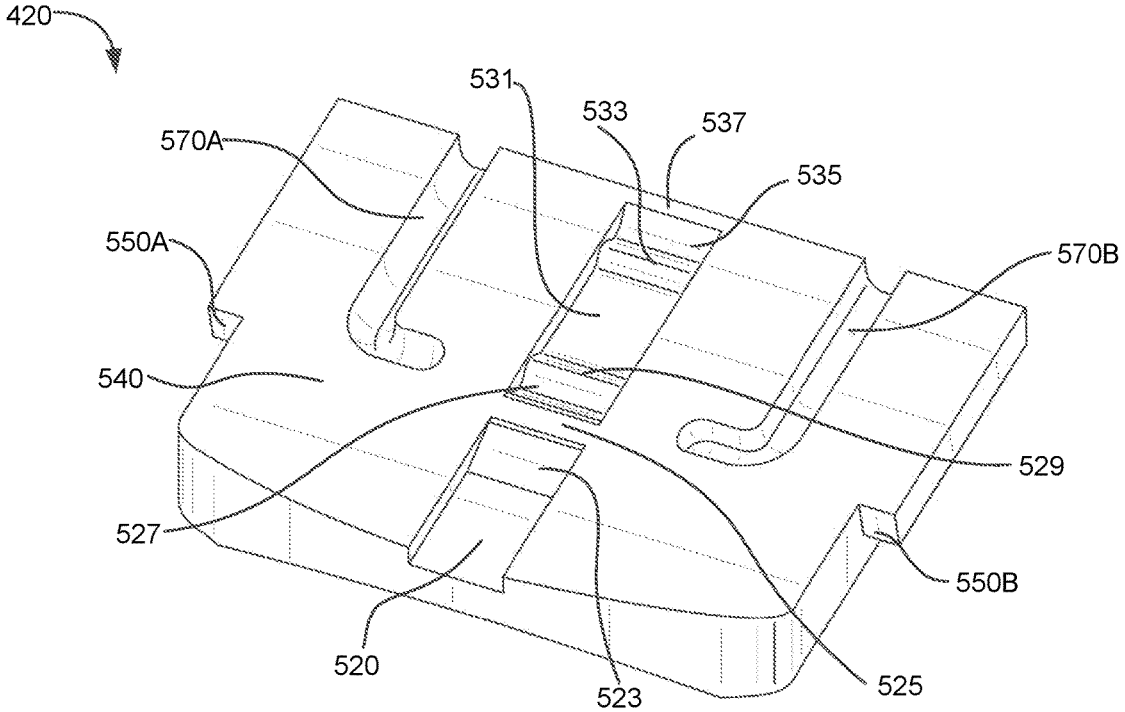
FIG. 16 illustrates the underside portion of non-winged slider.

FIGS. 14A and 14B illustrate a lid assembly 400 of the present disclosure. The lid assembly 400 includes a lid 410 and a non-winged slider 420 (shown in FIG. 16). The lid 410 has a nose recess 430 and a sip hole 414. FIG. 16A FIG. 14A shows the slider in an open position and FIG. 14B shows the slider in a closed position.

Figure 15:
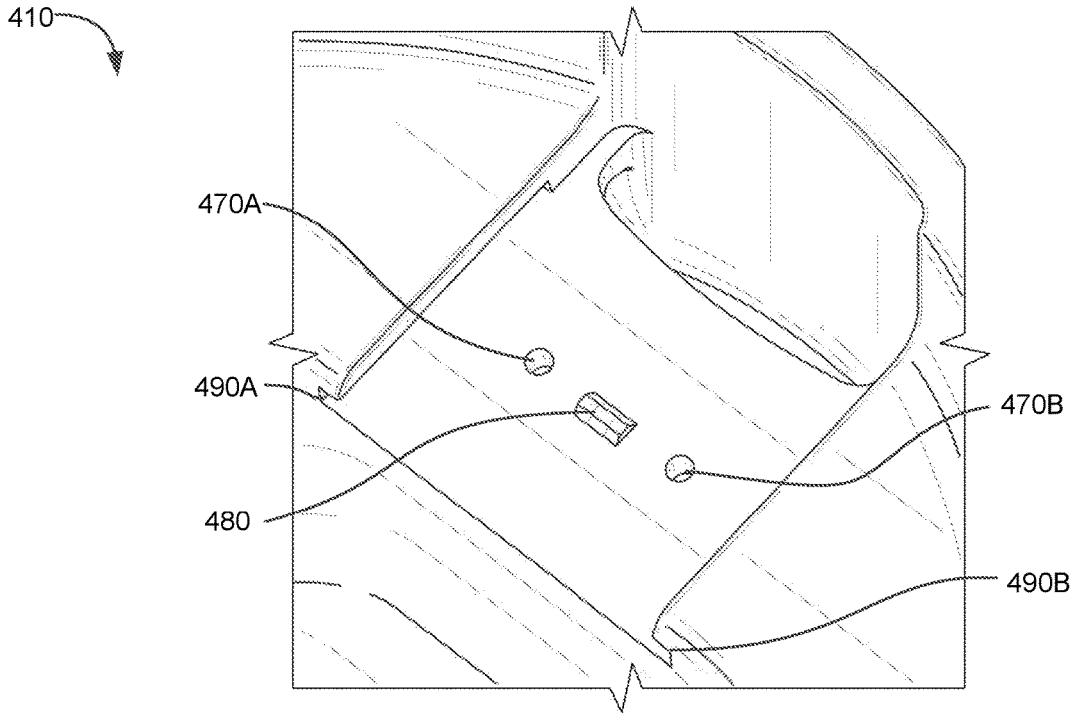
FIG. 15 illustrates the recessed portion of the lid with a non-winged slider.

FIG. 15 illustrates a recessed portion of the lid 410. FIG. 16 illustrates the underside portion of non-winged slider 420. As shown in FIG. 15, the lid 410 has pressure equalizing vents 470A and 470B and a central bump feature 480 that engages corresponding protuberances and depressions in channel 520 (shown in FIG. 16). Tracks 490A and 490B receive tabs 550A and 550B to keep slider close to the lid and allow sliding between open and close positions.

The underside of the non-winged slider 420 is shown in FIG. 16. Ramp 523 provides easy slider insertion capability by making the slider slide over the central bump 480. Once inserted, the central bump rests in depression 527. When the user wishes to cover the sip hole, it slides slider 420 so protuberance 529 goes over the central bump 480. In general, protuberance 529 is not as high as first protuberance 525 to allow easier operation when just closing slider, not removing it. Once the slider is passed the central bump, there is a free sliding over the mid channel 531 until protuberance 533 reaches the central bump 480. Closing the slider 420 over the sip hole requires an additional push to get the protuberance 533 over the bump 480. The slider 420 is in closed position when the bump is in depression 535. The last portion 537 of the slider 420 can be flat to form contact with the lid surface in order to better contain liquid infiltration. The amount of force required to go over the central bump 480 is controlled by the height of the protuberances in the slider channel, the height of the central bump 480 itself, and the flexibility of the slider 420. The flexibility of the slider 420 is a function of its shape and its material. To open and eventually remove the slider 420 for cleaning, the slider 420 is pushed backwards. To remove, a larger force is required to go over protuberance 525. A steeper ramp can be provided in this removal direction than in the inserting direction.

To equalize pressure during beverage consumption, vent channels 570A and 570B are provided to connect the vent holes 470A and 470B to the outside pressure. These vent channels may be curved as shown in FIG. 16 or may be straight or have alternative shapes.

Alternatively, the slider 420 central channel can have only one protuberance 525 that allows insertion while providing enough resistance in the opposite direction so that the slider 420 cannot easily be removed. The slider will then rely on friction to retain the close and open positions.

In yet another embodiment, the snap-fit features based on bumps, protrusions and depression as described here, can be built in the slider tabs and matched lid tracks profiles instead of at the bottom of the slider and top of the lid.

What is claimed is:

1. A lid assembly, comprising:

a lid configured to substantially cover an opening of a drink container, the lid comprising:

a sip hole;

a nose recess portion;

a first lid flat portion adjacent to the nose recess portion, the first lid flat portion comprising a first portion having a first vent hole; and a lid recess portion adjacent to the nose recess portion comprising a first track on a side wall adjacent to the first lid flat portion; and a slider adjacent to the nose recess portion configured to slide between an open position and a closed position, the slider comprising:

a central portion configured to fit the first lid recess portion, the central portion comprising a first tab on a side of the central portion to engage the first track; and a first flexible winged extension extending from the central portion along a side of the nose recess portion, first flexible winged extension configured to slide over the first lid flat portion, wherein the first flexible winged extension comprises a first channel such that when the slider is in the open position, the first channel exposes the first vent hole to an outside of the drink container, and when the slider is in the closed position, the first flexible winged extension covers the first vent hole; and wherein the lid further comprises:

a first lid step portion adjacent to the first lid flat portion that abuts an end of the first flexible winged extension when the slider is in the open position, wherein the slider can be removed from the first track by flexing the end of the first flexible winged extension over the first lid step portion.

2. The lid assembly of claim 1, wherein the first lid flat portion further comprises a first indentation, and the first flexible winged extension of the slider further comprises a first protrusion, wherein the first protrusion fits into the first vent hole when the slider is in the closed position and the first indentation when the slider is in the open position.

3. The lid assembly of claim 2, wherein the first protrusion enters the first indentation, and the first channel exposes the first vent hole to the outside of the drink container such that the slider slides to the open position to expose the sip hole, wherein the first channel exposing the first vent hole equalizes pressure with the outside of the drink container in the open position.

4. The lid assembly of claim 2, wherein the first protrusion enters the first vent hole, and the central portion moves to cover the sip hole such that the slider slides to the closed position to cover the sip hole.

5. The lid assembly of claim 2, wherein:

the first lid flat portion further comprises a second portion having a second vent hole and a second indentation;

the lid recess portion further comprises a second track adjacent to the second portion;

the slider further comprises a second winged extension configured to fit the second portion, the second winged extension comprising a second protrusion and a second channel, wherein the second protrusion fits the second vent hole and the second indentation, and the second channel exposes the second vent hole to the outside of the drink container; and the central portion further comprises a second tab to engage the second track.

6. The lid assembly of claim 5, wherein the first lid recess portion is located between the first and second portions, and the central slider portion is located between the first and second winged extensions.

7. The lid assembly of claim 2, wherein the first lid flat portion further comprises a second indentation located between the first vent hole and the first indentation, and the first flexible winged extension further comprises a second channel located between the first protrusion and the first channel, wherein the first protrusion enters the second indentation and the second channel exposes the first vent hole to air such that the slider slides to an intermediate open position to partially expose the sip hole.

8. The lid assembly of claim 2, wherein the first protrusion has a conical or spherical shape that lifts the first protrusion out of the first indentation when the slider is pushed against an edge of the first vent hole.

9. The lid assembly of claim 2, wherein the first protrusion and the first channel are located on a surface of the slider, and the surface is opposite to the first lid flat portion.

10. The lid assembly of claim 1, wherein the first lid flat portion is recessed relative to an upper surface of the lid.

11. The lid assembly of claim 10, wherein the first flexible winged extension slides along a lid guiding wall of the recessed first lid flat portion.

12. The lid assembly of claim 10, wherein the lid further comprises a slider insertion and removal system comprising a ramp extending from the first lid step portion such that the slider can be detached from the lid by sliding the end of the first flexible winged extension over the ramp.

13. The lid assembly of claim 12, wherein the slider insertion and removal system further comprises an additional ramp on the lid, wherein the additional ramp is inclined continuously and gradually from the first lid flat portion to an insertion step or top surface such that the slider continues sliding along the additional ramp without obstruction.

14. The lid assembly of claim 12, wherein the slider insertion and removal system further comprises a side-wall indentation that allows a finger to grab the first flexible winged extension from underneath and lift the first flexible winged extension over the first lid step portion to remove the slider.

15. The lid assembly of claim 12, wherein the slider insertion and removal system further comprises a tab on the first flexible winged extension that allows a finger to grab the first flexible winged extension from underneath and lift the first flexible winged extension over the first lid step portion to remove the slider.

16. The lid assembly of claim 12, wherein the slider insertion and removal system further comprises an insertion step.

17. The lid assembly of claim 1, wherein the central portion of the slider has a central profile that engages a central guiding channel in the lid to provide additional guidance.

18. The lid assembly of claim 2, wherein the first protrusion has a protrusion feature, and the first indentation and first vent have an indentation feature, wherein a combination of the protrusion feature and the indention feature provides a click-in-position functionality.

19. The lid assembly of claim 1, wherein an underside of the central portion of the slider has protrusions and notches that engage protrusions and notches in the lid to provide click in position functionality and slider separation control.

20. The lid assembly of claim 1, wherein the slider further comprises a handle to facilitate sliding the slider to the open position and the closed position.

* * * * *